US007774939B1

(12) United States Patent
Onion

(10) Patent No.: US 7,774,939 B1
(45) Date of Patent: Aug. 17, 2010

(54) STUD-LOCK KNIFE

(75) Inventor: Kenneth J. Onion, Kaneohe, HI (US)

(73) Assignee: KAI U.S.A., Ltd., Tualatin, OR (US)

( * ) Notice: Subject to any disclaimer, the term of this patent is extended or adjusted under 35 U.S.C. 154(b) by 1071 days.

(21) Appl. No.: 11/046,196

(22) Filed: Jan. 28, 2005

Related U.S. Application Data

(63) Continuation-in-part of application No. 10/825,848, filed on Apr. 16, 2004, now Pat. No. 7,506,446.

(51) Int. Cl.
*B26B 1/04* (2006.01)

(52) U.S. Cl. ..... 30/161; 30/160

(58) Field of Classification Search ..... 30/155, 30/158–161, 330, 331; 7/118
See application file for complete search history.

(56) References Cited

U.S. PATENT DOCUMENTS

| | | | |
|---|---|---|---|
| 23,975 | A | 5/1859 | Belcher |
| 57,902 | A | 9/1866 | Hibbard |
| 226,910 | A | 4/1880 | Friebertshauser |
| 338,251 | A | 3/1886 | Crandall et al. |
| 382,967 | A | 5/1888 | Fullerton |
| 530,792 | A | 12/1894 | Nordlow |
| 551,052 | A | 12/1895 | Waldron et al. |
| 552,928 | A | 1/1896 | Russell |
| 557,760 | A | 4/1896 | Brauer |
| 577,593 | A | 2/1897 | Bronson et al. |
| 600,442 | A | 3/1898 | Nell |
| 616,689 | A | 12/1898 | Ruettgers |
| 749,230 | A | 1/1904 | Severance |
| 777,358 | A | 12/1904 | Weck |
| 1,189,005 | A | 6/1916 | Seely |
| 1,315,503 | A | 9/1919 | Hughes |
| 1,319,532 | A | 10/1919 | Rasmussen |
| 1,357,398 | A | 11/1920 | Haywood |
| 1,412,373 | A | 4/1922 | Shields |
| 1,440,793 | A | 1/1923 | Rasmussen |
| 1,454,665 | A | 5/1923 | Bobek |
| 1,515,688 | A | 11/1924 | Love |

(Continued)

FOREIGN PATENT DOCUMENTS

| | | |
|---|---|---|
| DE | 1 104 386 | 4/1961 |

(Continued)

*Primary Examiner*—Boyer D. Ashley
*Assistant Examiner*—Edward Landrum
(74) *Attorney, Agent, or Firm*—Seed IP Law Group PLLC

(57) ABSTRACT

A folding knife includes a handle having a locking surface, a blade coupled to the handle and configured to rotate, relative to the handle, between a closed position and an open position, and a locking mechanism. The locking mechanism includes a locking post coupled to the blade and configured to move along a slot between a locking and a releasing position, with a biasing member configured to bias the post in the direction of the locking position. The post includes studs positioned above and below the plane of the blade. The studs may be rotatable around the axis, and the slot is positioned such that, when the blade is in the open position, the post may be moved toward the locking position until a face of the stud engages a locking surface of the handle, thereby locking the blade in the open position.

20 Claims, 10 Drawing Sheets

U.S. PATENT DOCUMENTS

| | | | | |
|---|---|---|---|---|
| 1,584,165 | A | 5/1926 | Brown | |
| 1,603,914 | A | 10/1926 | Hermann | |
| 1,614,949 | A | 1/1927 | Finley | |
| 1,701,027 | A | 2/1929 | Brown | |
| 1,743,022 | A | 1/1930 | Carman | |
| 1,810,031 | A | 6/1931 | Schrade | |
| 1,864,011 | A | 6/1932 | Brown | |
| 2,286,524 | A | 6/1942 | Wilbur | 30/161 |
| 2,304,601 | A | 12/1942 | Schrade | 30/159 |
| 2,407,897 | A | 9/1946 | Newman | 30/159 |
| 2,569,080 | A | 9/1951 | Trimble et al. | 30/320 |
| 2,596,294 | A | 5/1952 | Schrade | 30/161 |
| 2,736,959 | A | 3/1956 | Simon et al. | 30/123 |
| 3,079,784 | A | 3/1963 | Pavioski | 70/456 |
| 3,404,456 | A | 10/1968 | Chilko | 30/155 |
| 3,868,774 | A | 3/1975 | Miori | 30/161 |
| 4,040,181 | A | 8/1977 | Johnson | 30/161 |
| 4,133,106 | A | 1/1979 | Addis | 30/160 |
| 4,148,140 | A | 4/1979 | Lile | 30/161 |
| 4,173,068 | A | 11/1979 | Cargill | 30/161 |
| 4,218,819 | A | 8/1980 | Phelps | 30/157 |
| 4,240,201 | A | 12/1980 | Sawby et al. | 30/161 |
| 4,268,960 | A | 5/1981 | Reinschreiber | 30/161 |
| 4,274,200 | A | 6/1981 | Coder | 30/161 |
| 4,322,885 | A | 4/1982 | Osada | 30/162 |
| 4,347,665 | A | 9/1982 | Glesser | 30/161 |
| 4,356,631 | A | 11/1982 | Guth | 30/154 |
| 4,404,748 | A | 9/1983 | Wiethoff | 30/161 |
| 4,439,922 | A | 4/1984 | Sassano | 30/161 |
| 4,442,600 | A | 4/1984 | Felix-Dalichow | 30/161 |
| 4,451,982 | A | 6/1984 | Collins | 30/161 |
| 4,502,221 | A | 3/1985 | Pittman | 30/160 |
| 4,541,175 | A | 9/1985 | Boyd et al. | 30/161 |
| 4,570,341 | A | 2/1986 | Konneker | 30/161 |
| 4,604,803 | A | 8/1986 | Sawby | 30/161 |
| 4,612,706 | A | 9/1986 | Yunes | 30/160 |
| 4,670,984 | A | 6/1987 | Rickard | 30/161 |
| 4,719,700 | A | 1/1988 | Taylor, Jr. | 30/158 |
| 4,741,106 | A | 5/1988 | Yamagishi | 30/161 |
| 4,776,094 | A | 10/1988 | Glesser | 30/160 |
| 4,802,279 | A | 2/1989 | Rowe | 30/155 |
| 4,805,303 | A | 2/1989 | Gibbs | 30/161 |
| 4,811,486 | A | 3/1989 | Cunningham | 30/161 |
| 4,837,932 | A | 6/1989 | Elsener | 30/161 |
| 4,893,409 | A | 1/1990 | Poehlmann | 30/161 |
| 4,896,424 | A | 1/1990 | Walker | 30/349 |
| 4,947,552 | A | 8/1990 | Barnes | 30/161 |
| 4,974,323 | A | 12/1990 | Cassady | 30/155 |
| 4,979,301 | A | 12/1990 | Walker | 30/161 |
| 5,044,079 | A | 9/1991 | Gibbs | 30/160 |
| 5,060,379 | A | 10/1991 | Neely | 30/161 |
| 5,092,045 | A | 3/1992 | Boyd, Jr. et al. | 30/161 |
| 5,095,624 | A | 3/1992 | Ennis | 30/161 |
| 5,111,581 | A | 5/1992 | Collins | 30/161 |
| 5,131,149 | A | 7/1992 | Thompson et al. | 30/161 |
| D336,602 | S | 6/1993 | Thompson et al. | D8/99 |
| D338,386 | S | 8/1993 | Frazer | D8/105 |
| 5,293,690 | A | 3/1994 | Cassady | 30/161 |
| D345,688 | S | 4/1994 | McLean et al. | D8/356 |
| D348,599 | S | 7/1994 | Sakai | D8/99 |
| 5,325,588 | A | 7/1994 | Rogers | 30/161 |
| 5,331,741 | A | 7/1994 | Taylor, Jr. | 30/158 |
| 5,400,509 | A | 3/1995 | Collins | 30/161 |
| 5,425,175 | A | 6/1995 | Rogers | 30/161 |
| 5,437,101 | A | 8/1995 | Collins | 30/153 |
| 5,461,786 | A | 10/1995 | Miller | 30/161 |
| 5,467,256 | A | 11/1995 | Chen | 362/119 |
| D365,266 | S | 12/1995 | Hasegawa | D8/99 |
| 5,493,781 | A | 2/1996 | Saito | 30/162 |
| D367,807 | S | 3/1996 | Hung | D8/105 |
| 5,502,895 | A | 4/1996 | Lemaire | 30/158 |
| 5,511,310 | A | 4/1996 | Sessions et al. | 30/161 |
| 5,515,610 | A | 5/1996 | Levin et al. | 30/161 |
| 5,537,750 | A | 7/1996 | Seber et al. | 30/161 |
| 5,546,662 | A | 8/1996 | Seber et al. | 30/161 |
| D373,296 | S | 9/1996 | Thompson | D8/99 |
| 5,581,895 | A | 12/1996 | Jeffcoat | 30/294 |
| 5,596,808 | A | 1/1997 | Lake et al. | 30/161 |
| D377,744 | S | 2/1997 | Hasegawa | D8/99 |
| 5,615,484 | A | 4/1997 | Pittman | 30/161 |
| 5,647,129 | A | 7/1997 | Stamper | 30/139 |
| D384,871 | S | 10/1997 | McWillis | D8/99 |
| 5,685,079 | A | 11/1997 | Brothers et al. | 30/161 |
| 5,689,885 | A | 11/1997 | Walston | 30/160 |
| 5,692,304 | A | 12/1997 | Campbell | 30/161 |
| 5,699,615 | A | 12/1997 | Chen | 30/160 |
| D389,718 | S | 1/1998 | Wegner | D8/99 |
| D392,539 | S | 3/1998 | Balolia | D8/99 |
| 5,737,841 | A | 4/1998 | McHenry et al. | 30/161 |
| 5,755,035 | A | 5/1998 | Weatherly | 30/161 |
| 5,781,998 | A | 7/1998 | Stamper | 30/139 |
| 5,794,346 | A | 8/1998 | Seber et al. | 30/161 |
| 5,802,722 | A | 9/1998 | Maxey et al. | 30/160 |
| D399,113 | S | 10/1998 | Balolia | D8/99 |
| 5,815,927 | A | 10/1998 | Collins | 30/161 |
| 5,819,414 | A | 10/1998 | Marifone | 30/160 |
| 5,822,866 | A | 10/1998 | Pardue | 30/161 |
| 5,826,340 | A | 10/1998 | Hull | 30/161 |
| 5,839,194 | A | 11/1998 | Bezold | 30/161 |
| D402,178 | S | 12/1998 | Glesser | D8/99 |
| 5,845,404 | A | 12/1998 | Jeffcoat | 30/125 |
| 5,875,552 | A | 3/1999 | Chen | 30/161 |
| 5,887,347 | A | 3/1999 | Gibbs | 30/161 |
| D407,961 | S | 4/1999 | Balolia | D8/99 |
| 5,964,036 | A | 10/1999 | Centofante | 30/161 |
| 5,966,816 | A | 10/1999 | Roberson | 30/156 |
| 6,079,106 | A | 6/2000 | Vallotton | 30/161 |
| 6,122,829 | A | 9/2000 | McHenry et al. | 30/161 |
| 6,125,543 | A | 10/2000 | Jhones | 30/161 |
| 6,145,202 | A | 11/2000 | Onion | 30/160 |
| D434,631 | S | 12/2000 | Lum | D8/99 |
| 6,154,965 | A * | 12/2000 | Sakai | 30/161 |
| 6,158,127 | A | 12/2000 | Taylor | 30/158 |
| 6,233,769 | B1 | 5/2001 | Seber et al. | 7/128 |
| D444,685 | S | 7/2001 | Shenkel et al. | D8/18 |
| 6,256,888 | B1 | 7/2001 | Shuen | 30/161 |
| 6,276,063 | B1 | 8/2001 | Chen | 30/161 |
| 6,289,592 | B1 | 9/2001 | Emerson | 30/161 |
| 6,308,420 | B1 * | 10/2001 | Moser | 30/161 |
| 6,338,431 | B1 | 1/2002 | Onion | 230/161 |
| 6,363,615 | B1 | 4/2002 | Moser | 30/161 |
| 6,378,214 | B1 * | 4/2002 | Onion | 30/161 |
| 6,397,477 | B1 | 6/2002 | Collins | 30/161 |
| 6,427,334 | B2 | 8/2002 | Onion | 30/161 |
| 6,427,335 | B1 | 8/2002 | Ralph | 30/161 |
| 6,430,816 | B2 | 8/2002 | Neveux | 30/161 |
| 6,434,831 | B2 | 8/2002 | Chen | 30/161 |
| 6,438,848 | B1 * | 8/2002 | McHenry et al. | 30/161 |
| D462,582 | S | 9/2002 | Parlowski | D7/649 |
| D466,422 | S | 12/2002 | Luquire | D10/62 |
| 6,490,797 | B1 | 12/2002 | Lake et al. | 30/161 |
| 6,553,671 | B2 | 4/2003 | Blanchard | 30/161 |
| 6,560,877 | B2 | 5/2003 | Sanelli | 30/340 |
| 6,591,504 | B2 | 7/2003 | Onion | 30/160 |
| 6,651,344 | B2 | 11/2003 | Cheng | 30/159 |
| 6,684,510 | B1 | 2/2004 | Collins | 30/161 |
| 6,751,868 | B2 | 6/2004 | Glesser | 30/161 |
| 7,121,005 | B2 * | 10/2006 | Hughes | 30/158 |
| 2002/0157260 | A1 | 10/2002 | Cheng | 30/161 |
| 2003/0070299 | A1 | 4/2003 | Frazer | 30/161 |
| 2004/0134075 | A1 | 7/2004 | Chu | 30/161 |
| 2004/0158991 | A1 | 8/2004 | Freeman | 30/161 |

2005/0223562 A1* 10/2005 Pardue et al. ..... 30/161

FOREIGN PATENT DOCUMENTS

| | | | |
|---|---|---|---|
| EP | 0 230 000 | | 7/1987 |
| FR | 493 741 | | 8/1919 |
| FR | 1 171 740 | | 1/1959 |
| FR | 1 248 117 | | 10/1960 |
| FR | 2 705 606 | | 12/1994 |
| JP | 4-30979 | | 2/1992 |
| JP | 5-185381 | | 7/1993 |
| JP | 2000-140459 | A | 5/2000 |
| TW | 569902 | | 1/2004 |

* cited by examiner

STUD-LOCK KNIFE

CROSS-REFERENCE TO RELATED APPLICATION

This application is a continuation-in-part of application Ser. No. 10/825,848, filed Apr. 16, 2004, which application is incorporated herein by reference in its entirety.

BACKGROUND OF THE INVENTION

1. Field of the Invention

The present disclosure relates generally to a folding knife, and particularly to a folding knife with a locking mechanism that locks the blade in an open position.

2. Description of the Related Art

Folding knives enjoy wide popularity, particularly among sportsmen, campers, hikers, and many others engaged in outdoor activities. Common elements to folding knives include a handle and a blade pivotally connected to an end of the handle so that the blade pivots with respect to the handle between an open position in which the blade is extended away from the handle and a closed position in which the blade is at least partially received within the handle. Many folding knives also include a locking mechanism to maintain the blade in an open position.

Examples of folding knives, including folding knives with locking mechanisms, may be found in U.S. Pat. Nos. 1,454,665; 1,743,022; 4,040,081; 4,404,748; 4,451,982; 4,502,221; 4,719,700; 4,805,303; 4,811,486; 4,837,932; 4,893,409; 4,974,323; 4,979,301; 5,044,079; 5,060,379; 5,095,624; 5,111,581; 5,293,690; 5,325,588; 5,331,741; 5,425,175; 5,502,895; 5,515,610; 5,537,750; 5,615,484; 5,685,079; 5,689,885; 5,692,304; 5,737,841; 5,755,035; 5,802,722; 5,822,866; 5,826,340; 5,887,347; 5,964,036; 6,079,106; 6,154,965; 6,338,431; 6,378,214; 6,427,335; and 6,438,848; and U.S. Patent Application Nos. 2002/0157260 and 2003/0070299, the entire disclosures of which are herein incorporated by reference for all purposes.

A simple mechanism for locking and unlocking the blade of a folding knife, particularly one that may be operated with a single thumb-actuated motion while the user's hand is holding the knife, may enhance the utility of the knife. That mechanism may be of further utility if it also may be used for one-handed opening and/or closing of the blade.

BRIEF SUMMARY OF THE INVENTION

According to an embodiment of the invention, a folding knife is provided, comprising a handle, a blade, and a locking mechanism. The handle includes a locking surface on an end face thereof, and the blade includes a tang end and a point end. The blade is rotatably coupled near its tang end to the handle and configured to rotate, relative to the handle, around a first axis between a closed position, in which the blade is partially received in the handle, and an open position, in which the blade extends away from the handle. The locking mechanism includes a locking post coupled to the blade and extending along a second axis lying parallel to the first axis.

The locking post is configured to slide in a slot in the blade, between a locking and a releasing position, with a biasing member configured to bias the post in the direction of the locking position. The post includes a stud positioned above the plane of the blade, which has at least one face whose contour conforms to a contour of the locking surface. The stud may have a polygonal shape, such as a hexagon, square, or heptagon, for example, or may be non-polygonal, such as round or oval, for example. The stud may be rotatable around the second axis. The slot is positioned such that, when the blade is in the open position, the post may be moved toward the locking position until the face of the stud engages the locking surface, thereby locking the blade in the open position.

BRIEF DESCRIPTION OF THE SEVERAL VIEWS OF THE DRAWING(S)

Figure 13:
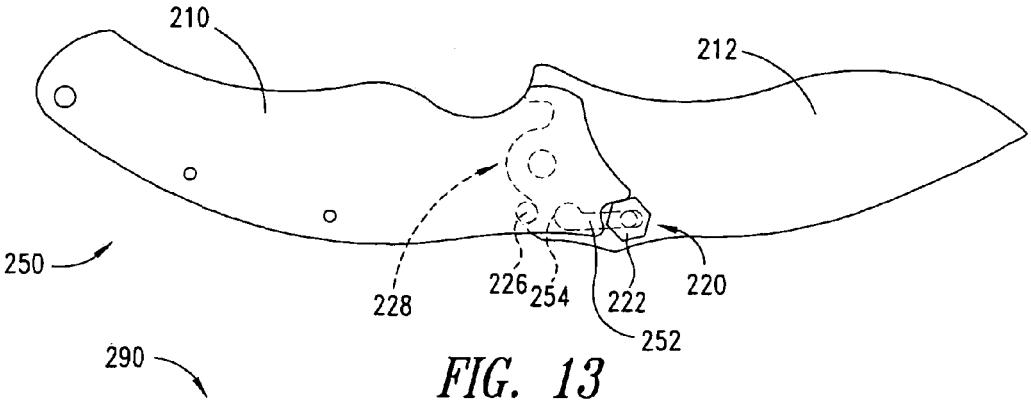
Figure 14:
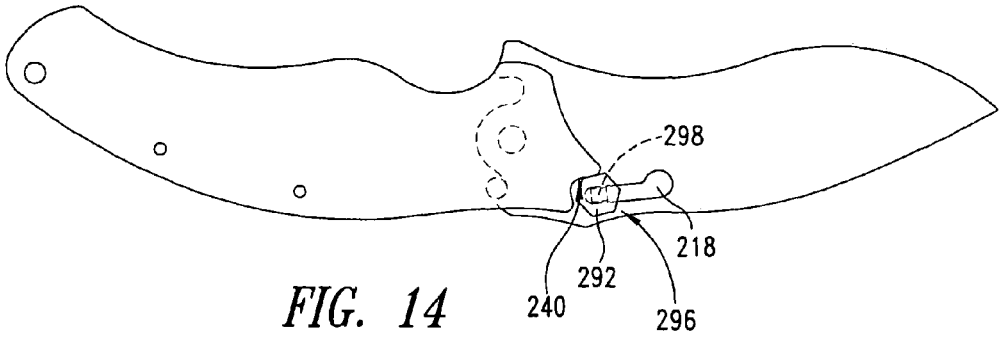

FIGS. 13 and 14 each illustrate a folding knife according to a different embodiment of the invention.

Figure 15A:
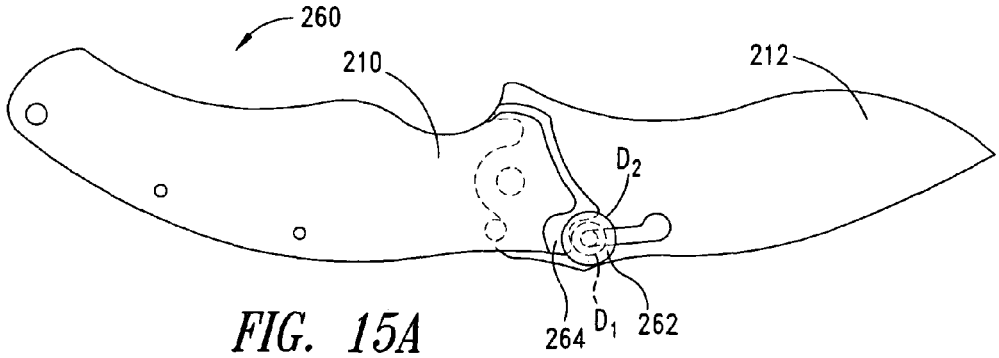
Figure 15B:
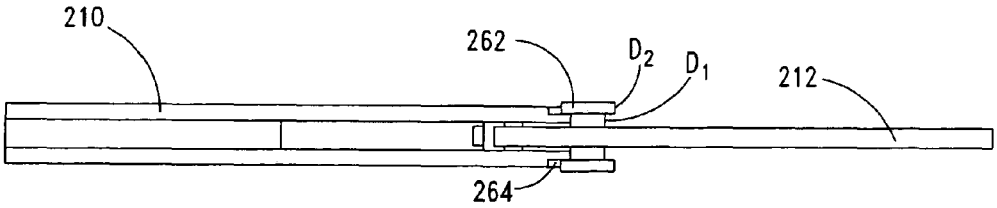

FIGS. 15A and 15B illustrate another embodiment of the invention in side and back views, respectively.

Figure 16A:
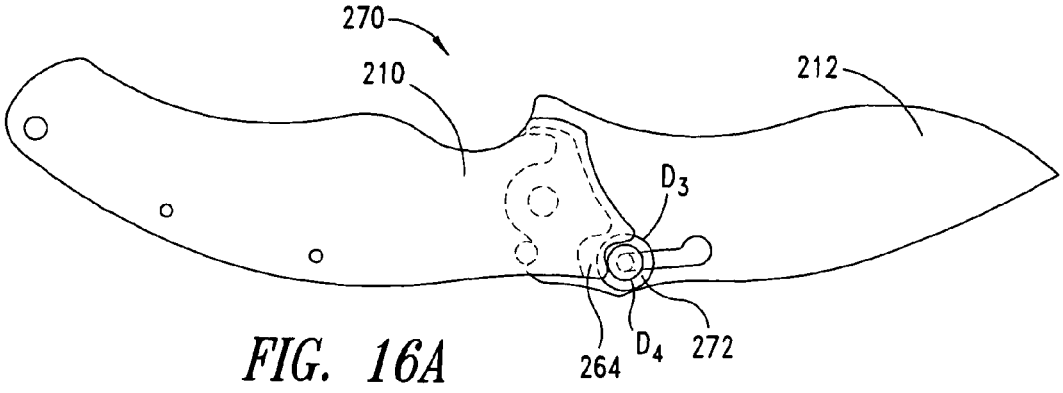
Figure 16B:
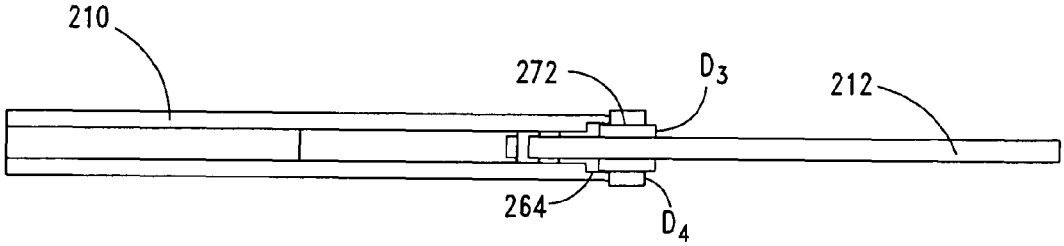

FIGS. 16A and 16B illustrate another embodiment of the invention in side and back views, respectively.

Figure 17A:
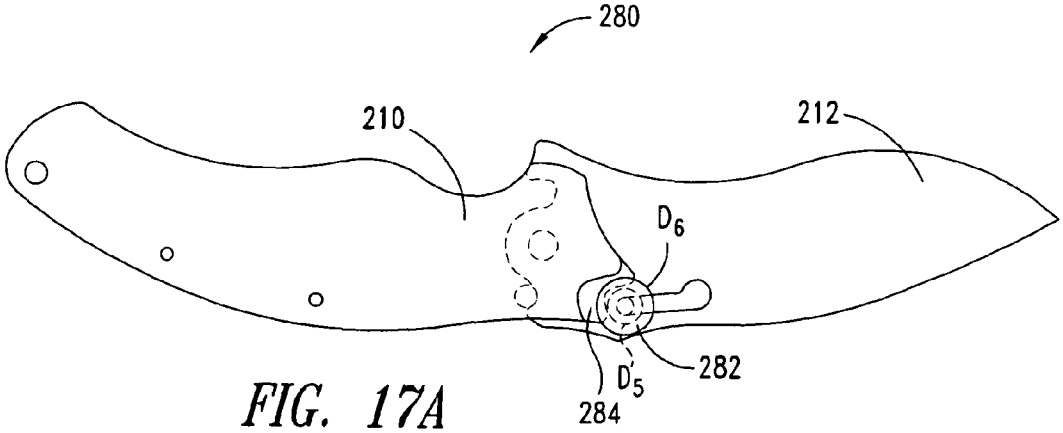
Figure 17B:
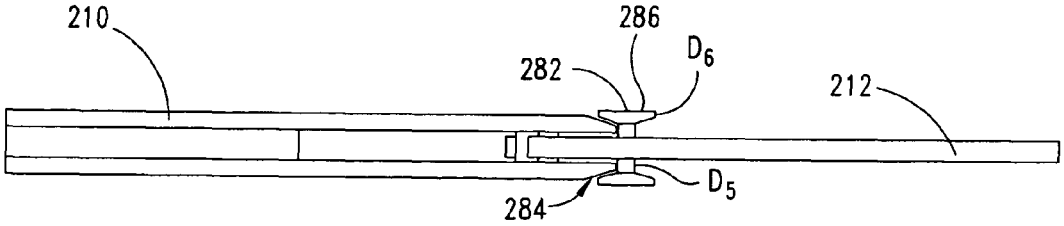

FIGS. 17A and 17B illustrate another embodiment of the invention in side and back views, respectively.

Figure 18:
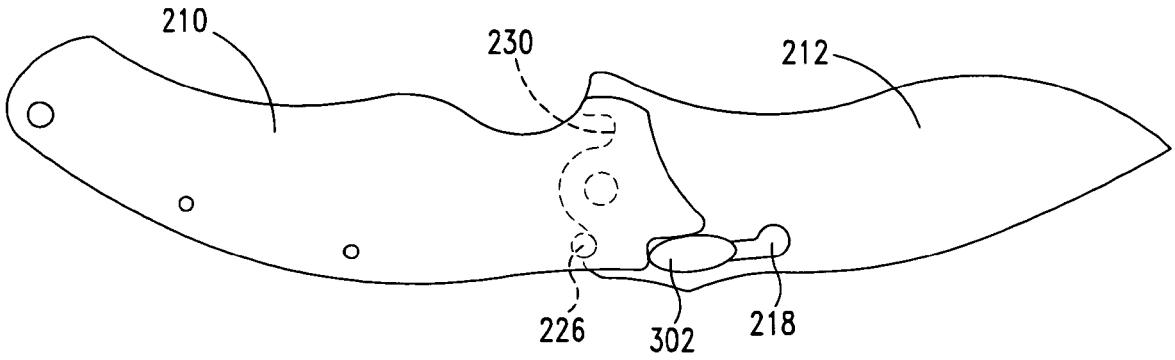
Figure 19:
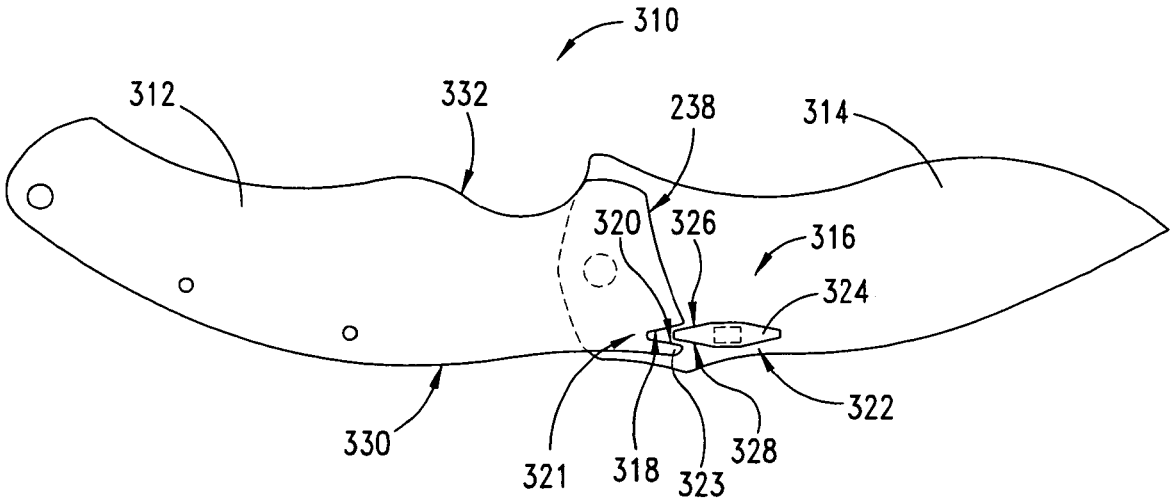

FIGS. 18 and 19 each illustrate a folding knife according to further embodiments of the invention.

DETAILED DESCRIPTION OF THE INVENTION

Figure 1:
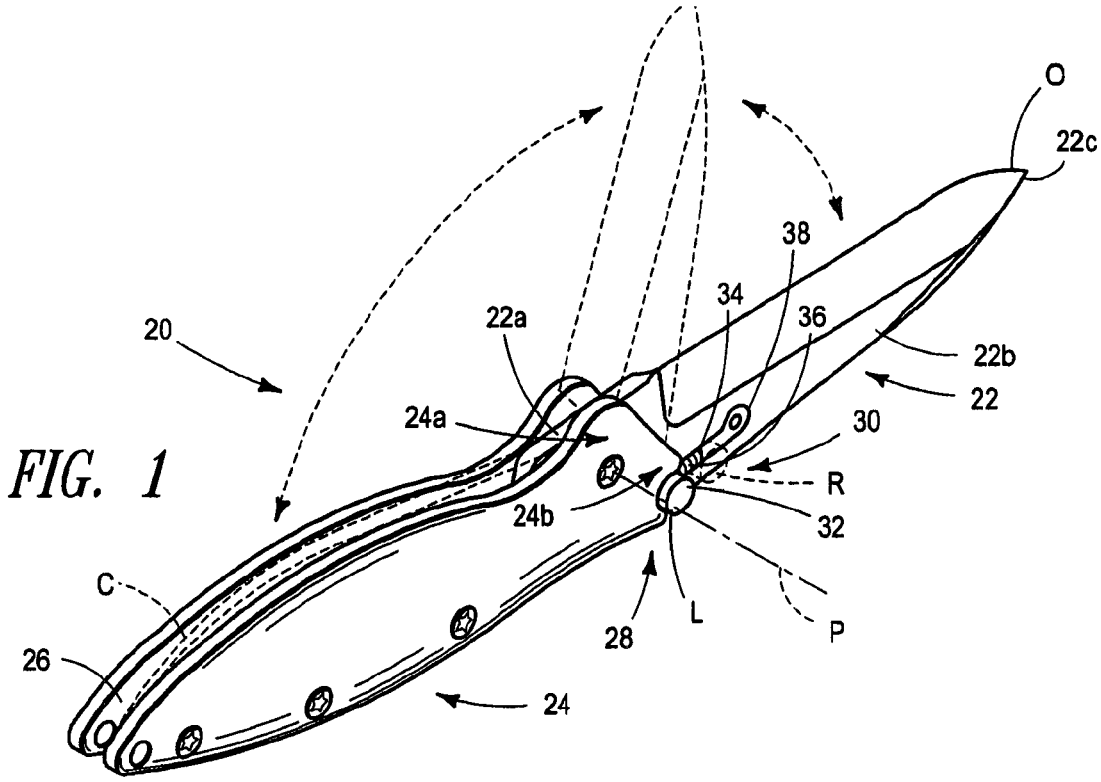
FIG. 1 is an isometric view of a folding knife incorporating a locking mechanism, according to an embodiment of the present invention.
Figure 2:
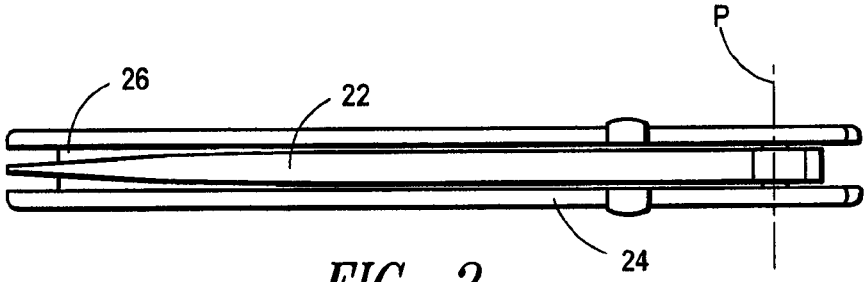
FIG. 2 is a front plan view of the knife of FIG. 1, showing the knife blade stored within a blade-receiving channel in the handle.
Figure 3:
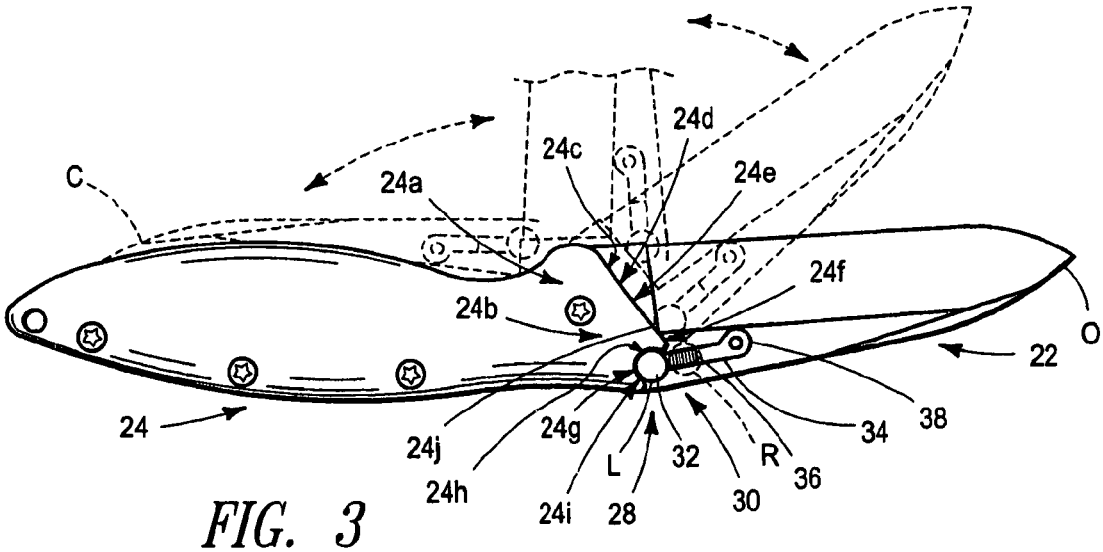
FIG. 3 is a side view of the folding knife of FIG. 1, showing pivoting of the blade between open and closed positions.

FIGS. 1-3 depict an embodiment of a folding knife 20 having a blade 22, a handle 24 defining a blade-receiving channel 26, and a locking mechanism 28. Blade 22 includes a tang 22*a* pivotally connected to an end 24*a* of handle 24. The blade pivots with respect to the handle about a pivot axis P between an open position O and a closed position C. In the open position, the blade is extended away from the handle so that it is deployed and ready for use. From the open position, the blade may be folded towards the handle into the closed position, in which the blade may be at least partially received for storage within blade-receiving channel 26 defined in the handle. In the closed position, blade 22 extends along handle 24.

Locking mechanism 28 may include a first locking element 24*b* and a second locking element 30. First locking element 24*b* may include any structure configured to engage second locking element 30 and lock blade 22 in the open position. For example, as shown in FIGS. 1 and 3, the first locking element may be formed from an end face 24*c* and/or an exposed exterior edge surface 24*d* of handle end 24*a*. Alternatively, or additionally, at least part of the first locking element may be attached to that end face and/or that edge surface on one or both sides of handle 24. First locking element 24*b* may include an angled end portion 24*e*, a locking portion 24*g*, and a corner 24*f* separating those two portions. Locking portion 24*g* may include a latching corner 24*h*, and/or a notched corner 24*i* configured to receive second locking element 30. Although the exemplary first locking element 24*b* is discussed as including a latching corner and/or notched corner formed on the handle end, virtually any other suitable structure configured to interact with at least part of second locking element 30 to selectively lock blade 22 in the open position may be used, such as latching elements, locking cutouts, holes, notches, or mechanical, magnetic, or electronic devices, or the like.

Second locking element 30 may include any structure configured to lock blade 22 in the open position. The second locking element also may be configured to open and/or close the blade. For example, as shown in FIGS. 1 and 3, the second locking element may include a post 32. The post may extend transversely from a flat surface 22*b* of blade 22 and may be positioned near blade tang 22*a*. Post 32 also may be spaced from pivot axis P so that the post is exposed during the rotation of blade 22 between the open and closed positions. Post 32 may be mounted for sliding movement in a slot 34 defined through blade 22 so that the post slides along the surface of the blade. Post 32 may be slidable in slot 34 between a first or locking position L at one end of the slot and a second or retracted position R at the other end of the slot, the locking position being spaced further from a blade point 22*c* compared to the retracted position.

FIG. 3 shows the interaction of post 32 with end face 24*c* as the blade is pivoted with respect to the handle, including the locking of the blade in open position O. As blade 22 is rotated from the closed position towards the open position, post 32 may remain spaced apart from end face 24*c* until it engages angled end portion 24*e* at an engagement position 24*j*. The engagement position may be varied by varying the shape of angled end portion 24*e*. For example, the angled end portion may be configured such that post 32 does not engage handle end 24*a* until the blade is at least approximately 75% towards the open position from the closed position. Other configurations for angled end portion 24*e* are possible and may be used.

With further rotation of blade 22, post 32 may pass around corner 24*h* and into locking portion 24*g* of handle end 24*a*. While post 32 is maintained in locking position L, locking portion 24*g* of handle end 24*a* may block the post and thus prevents blade 22 from being pivoted towards closed position C. The interaction between post 32 and handle end 24*a* may provide for a smooth opening of blade 22, while still providing feedback to the user that blade 22 has been locked in the open position by movement of post 32 into the locking position.

To unlock blade 22, post 32 may be pushed towards retracted position R to disengage the post from locking portion 24*g* of handle end 24*a*. Once post 32 and locking portion 24*g* are disengaged, handle end 24*a* no longer blocks the post, and blade 22 may be pivoted towards the closed position.

Figure 4:
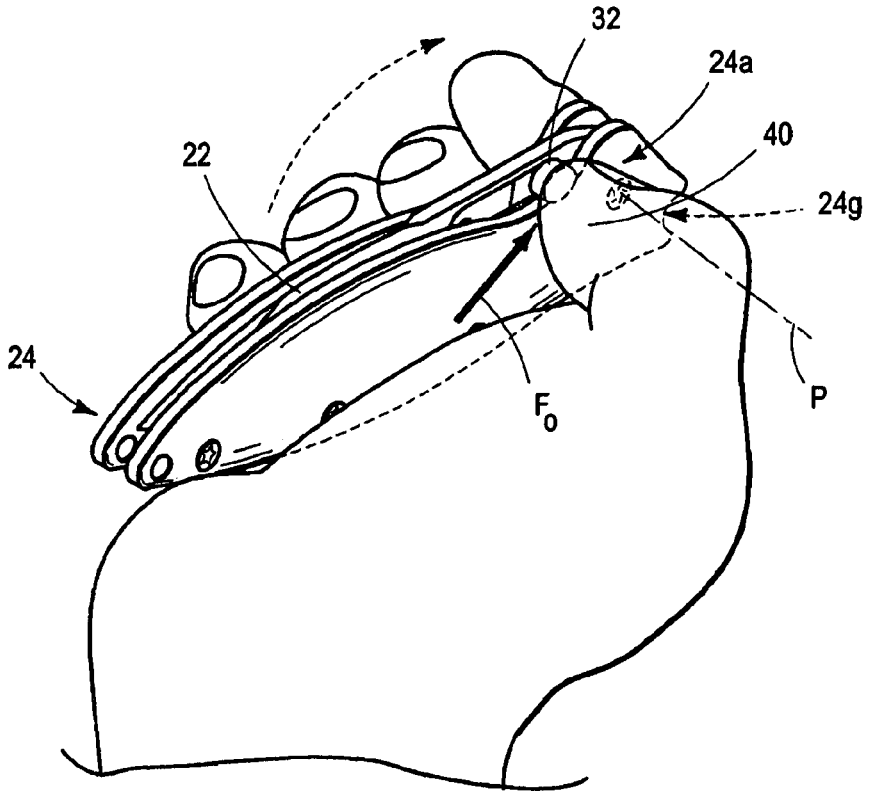
FIG. 4 is an isometric view showing the thumb of a user's hand positioned for opening and locking the blade of the knife of FIG. 1.

FIG. 4 depicts the folding knife of FIGS. 1-3 being opened by a user's hand. As will be appreciated from this and the preceding figures, post 32 may be positioned on blade 22 so that it is exposed for manipulation by a user throughout the entire range of the blade's pivotal travel. Because post 32 may extend transversely from the blade and may be spaced from pivot axis P, an external force parallel to the plane of the blade may be exerted upon the post to cause the blade to pivot with respect to the handle.

Thumb 40 may exert an opening force $F_o$ on post 32 to cause blade 22 to pivot towards the open position. As indicated, the position of the post may allow the blade to be easily opened with one hand with a simple thumb-actuated motion. Additionally, the depicted knife may be provided with an actuating bias element operatively connecting the handle to the blade, such as described in U.S. Pat. No. 6,378,214, to further facilitate opening and/or closing of the blade.

Figure 5:
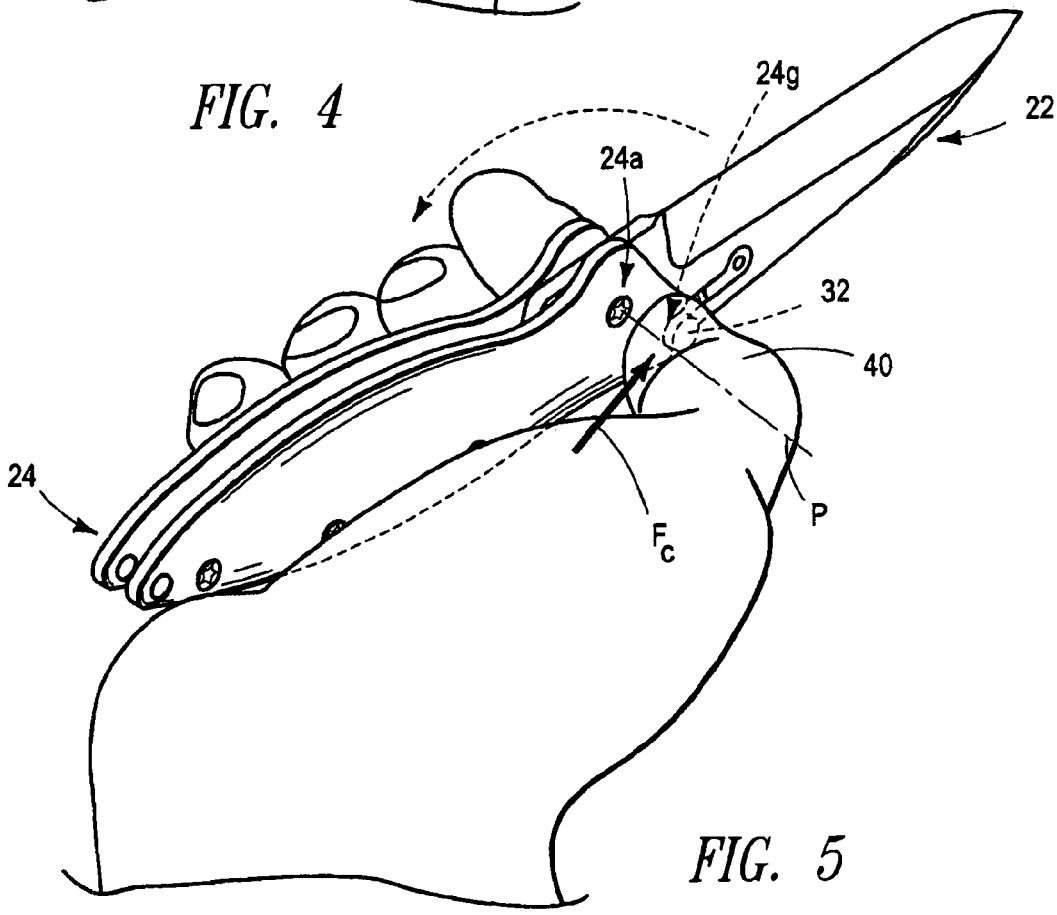
FIG. 5 is an isometric view showing a user's hand positioned for unlocking and closing the blade of the knife of FIG. 1.

As shown in FIG. 5, a similar motion may be used to unlock blade 22 and rotate the blade from the open position into the closed position. Thumb 40 is shown to exert a closing/unlocking force $F_c$ upon post 32 to move the post toward retracted position R sufficiently to disengage the post from locking portion 24*g* of handle end 24*a*, allowing the blade to be rotated towards the closed position.

Figure 6:
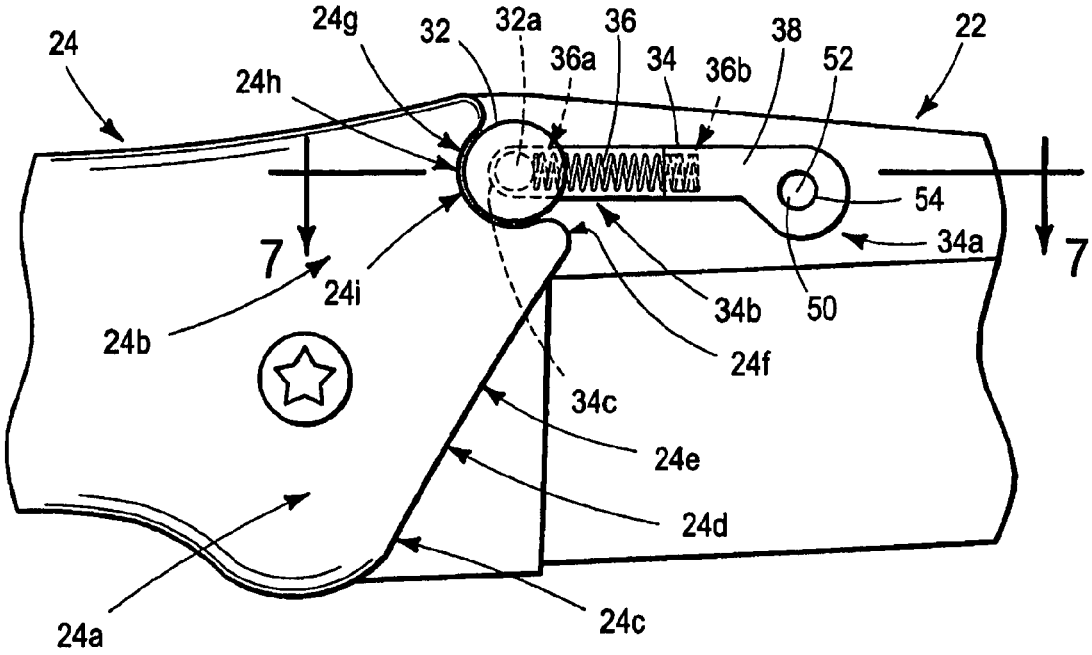
FIG. 6 is an enlarged, fragmentary side view of a knife incorporating the blade locking mechanism of FIG. 1.
Figure 7:
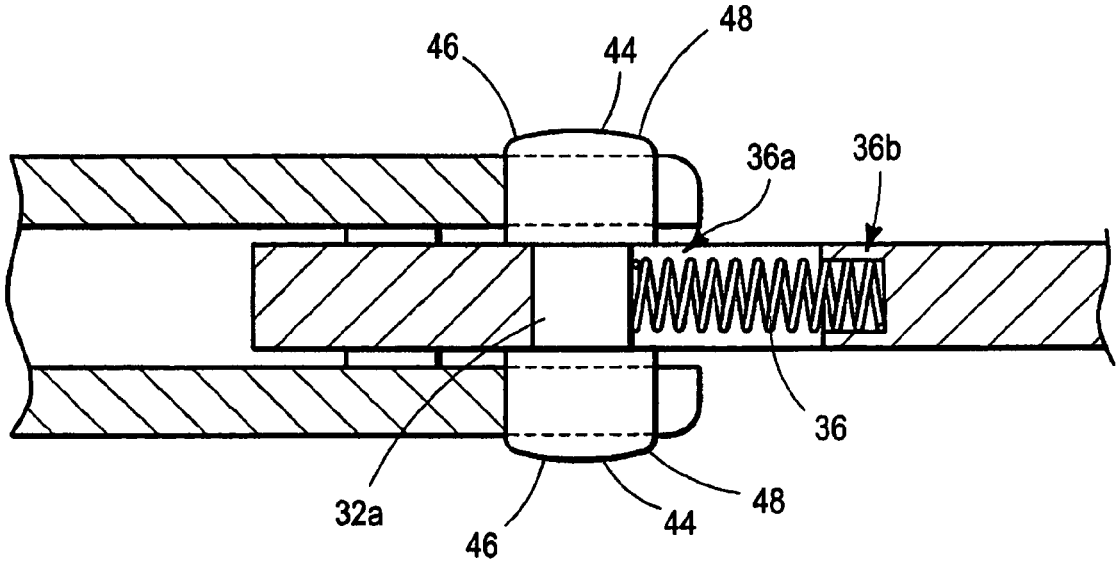
FIG. 7 is a partially sectioned top view of the folding knife taken along line 7-7 shown in FIG. 5.

As shown in FIGS. 6 and 7, post 32 may include a neck or pin 32*a*. Post 32 also may include one or more retainers 44 that may retain pin 32*a* in slot 34, provide a bearing surface by a user, and/or act as roller bearings. During opening, retainers 44 may roll as they bear against handle end 24*a* from engagement position 24*j* through corner 24*f* and into locking portion 24*g*, thereby preventing any scratching or wearing of the handle end, and improving the smoothness of the locking mechanism. This same benefit may be operative during blade closing, except that the order in which portions of handle end 24*a* may be encountered by retainers 44 would be reversed. The retainers 44 may also be referred to as studs.

Retainers 44 and pin 32*a* may collectively define a stacked-disk shape where the retainers extend co-axially on the ends of the pin, as shown in FIG. 7. A post having that shape has been found to be easily engaged by the thumb of a hand, without the thumb rolling off the retainers. Retainers 44 may include enlarged knobs 46 and/or enlarged ends 48 that may be attached to or integral with pin 32*a*. For example, the retainers may be pressed, swaged, threaded, or welded, and/or the reduced diameter neck region of pin 32*a* may be machined from larger stock. The pin and retainers may roll together, or may be rotatably mounted on the pin so that the retainers may roll around the pin.

Slot 34 may include a wide or first portion 34*a* and a narrow or second portion 34*b*, as shown in FIG. 6. First portion 34*a* may be configured to receive at least one of the retainers 44. Second portion 34*b* may be sized larger in width than the diameter of pin 32*a* of post 32 to accommodate that pin, but smaller in width than the diameter of retainers 44 to prevent passage of those retainers laterally. Thus, post 32 may be slidably located in slot 34 by inserting one of the retainers 44 into first portion 34*a* and then sliding pin 32*a* through second portion 34*b* towards a slot end 34*c*.

Figure 8:
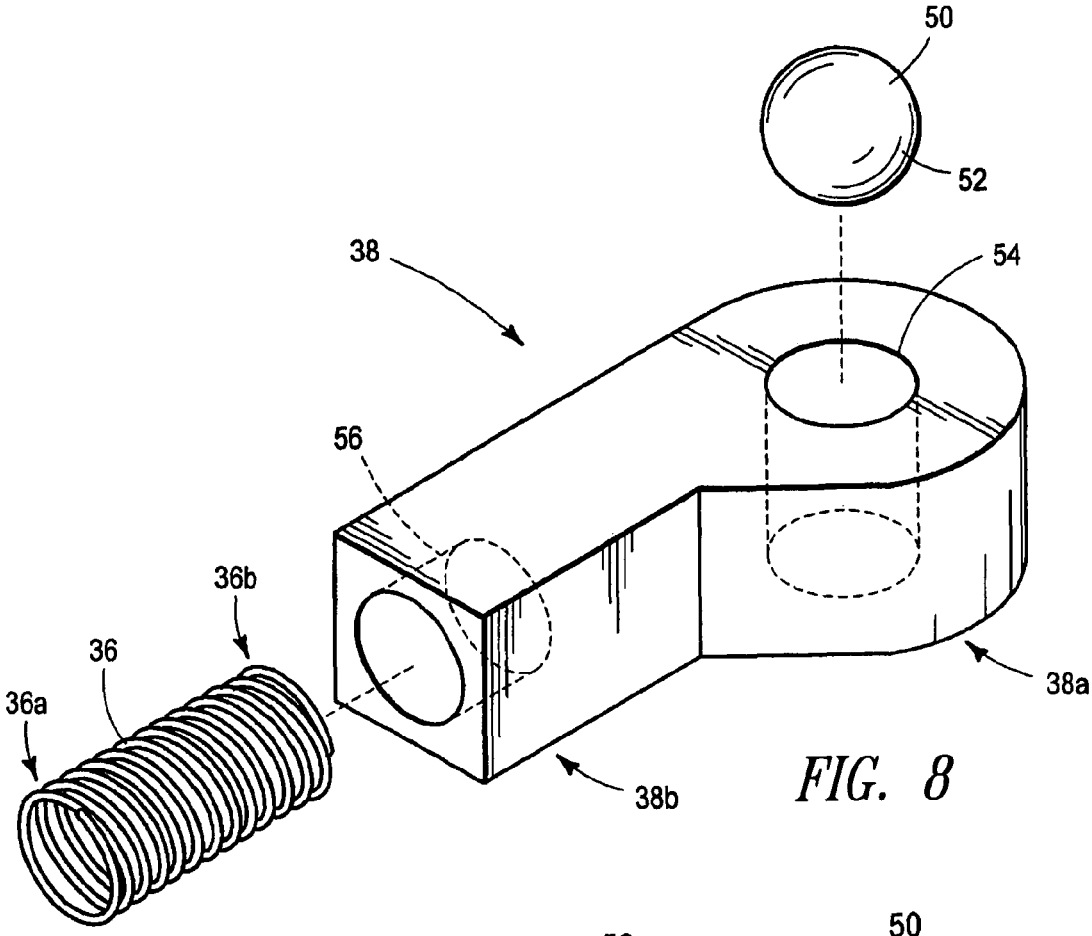
FIG. 8 is an exploded isometric view of a retaining element, a bias element, and an expander as may be used in the embodiment of FIG. 1.
Figure 9:
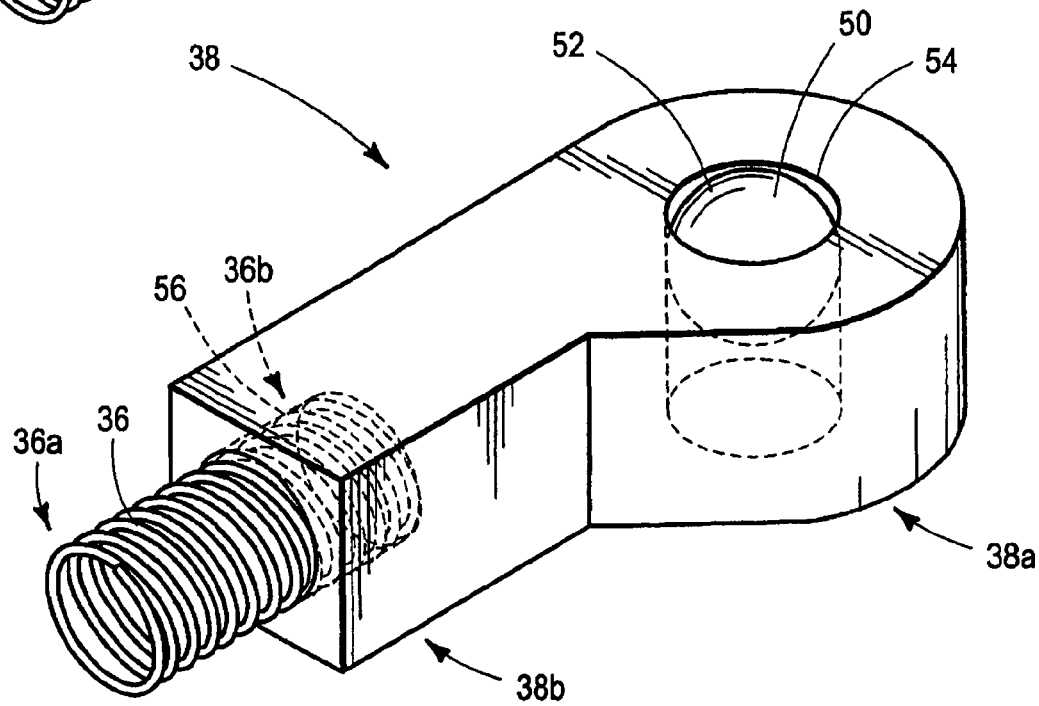
FIG. 9 is an isometric view of the retaining element of FIG. 8 showing the bias element and the expander received in the retaining element.

Locking mechanism 28 also may include a retaining element 38 configured to prevent movement of pin 32*a* in slot 34 from second portion 34*b* into first portion 34*a* of the slot. As shown in FIGS. 8 and 9, retaining element 38 may include a rounded portion 38*a* and an elongate portion 38*b*. The rounded portion may be configured to fit in first portion 34*a* of slot 34, such as by friction fit. The elongate portion may be configured to fit in at least part of second portion 34*b* of slot 34 adjacent to portion 34*a*. Elongate portion 38*b* may be square, rectangular, or any suitable shape in cross section. Although the exemplary retaining element is shown to include elongate and rounded portions, virtually any suitable shape or configuration adapted to prevent pin 32*a* from entering first portion 34*a* of slot 34 may be used.

Rounded portion 38*a* of retaining element 38 may include a hole 54, which may be configured to receive expander 50 and expand retaining element 38. Hole 54 in rounded portion 38*a* may go completely through the rounded portion from one side to the other, or may only partially go through that rounded portion. An expander 50 may be inserted into a hole 54 in retaining element 38 thereby expanding that retaining element, increasing the pressure between the retaining element and the blade surface forming the slot, and/or better securing it in slot 34. Expander 50 may include a ball bearing 52, a rounded pin, and/or any other suitable expander configured to secure the retaining element in slot 34. Elongate portion 38*b* may include a recess 56 configured to receive a bias element, as discussed below.

Furthermore, the locking mechanism may include a bias element 36 configured to urge pin 32*a* of post 32 towards end face 24*c* of handle end 24*a*. The bias element may be configured to urge post 32 toward locking position L. Thus, a user may push post 32 against bias element 36 to move the post into retracted position R.

Bias element 36 may include a first end 36*a* and a second end 36*b*. Bias element 36 may be positioned in slot 34 and secured between blade 22 and pin 32*a* of post 32 to urge the post along the slot towards slot end 34*c* into the locking position. First end 36*a* of bias element 36 may abut pin 32*a* of post 32, while second end 36*b* may abut retaining element 38. First end 36*a* may be trapped between retainers 44, between enlarged knobs 46, or between enlarged ends 48 provided on post 32, or may simply bear against the pin. Second end 36*b* may be received in a recess 56 of elongate portion 38*b*, or may simply bear against that elongate portion. Although bias element 36 is depicted in FIGS. 6-9 as a coiled spring, it may be of any other suitable type of bias element configured to urge the post towards the end face of the handle end, such as wire springs, leaf springs, or other resilient material or structure.

Although the exemplary second locking element 30 discussed includes a post, virtually any other suitable structures, such as latches or hooks, or mechanical, magnetic, or electronic devices, or the like, configured to engage at least part of first locking element 24*b* and selectively lock blade 22 in the open position may be used.

Figure 10:
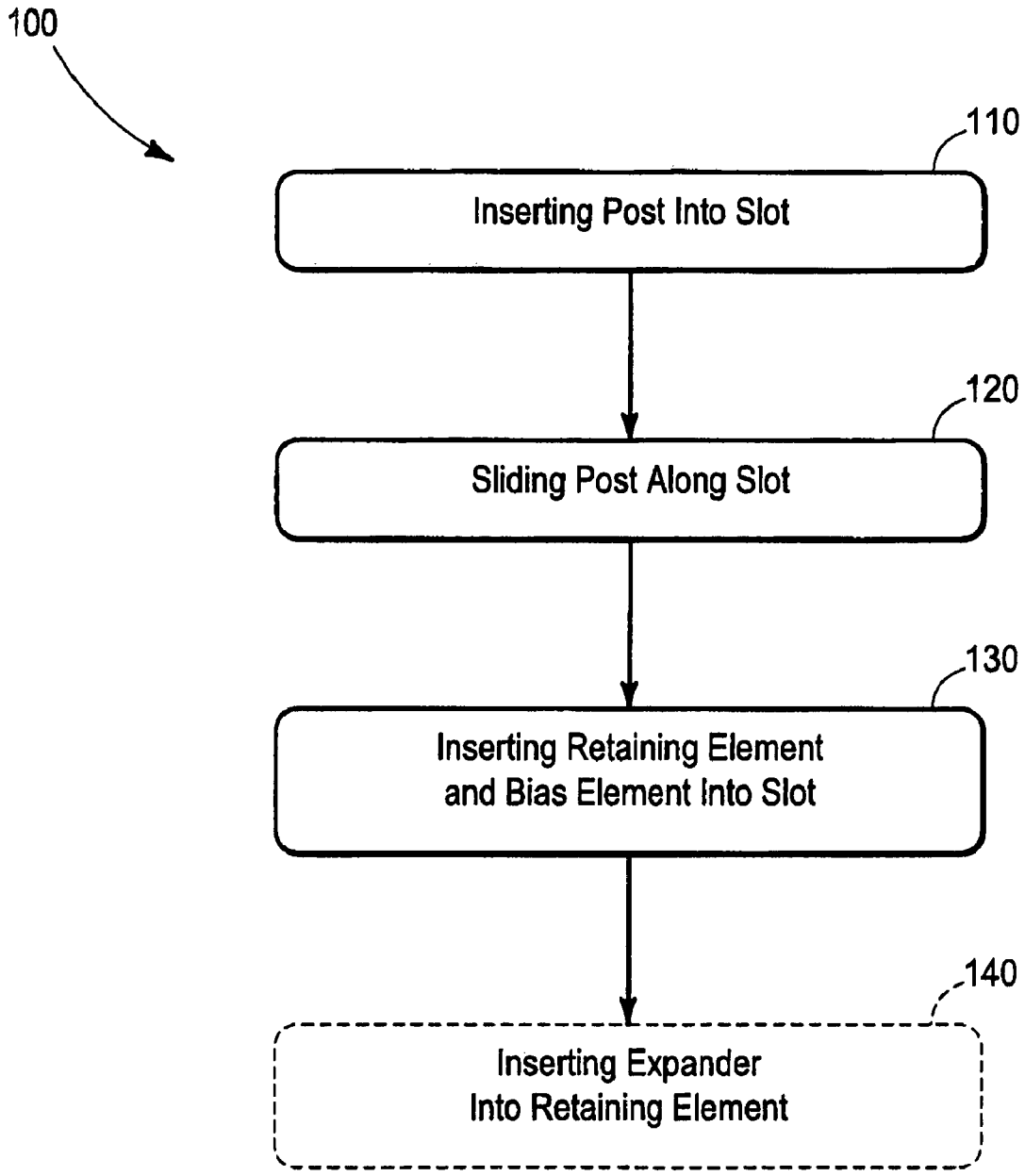
FIG. 10 is a flowchart of a method for assembling a locking mechanism.

FIG. 10 provides a flow chart of a method for assembling a locking mechanism, such as locking mechanism 28, as described above. At 110, the post may be inserted into the first portion of the slot so that each of retainers 44 jut from either side of blade 22. At 120, the post may be slid within the slot along its elongate portion to slot end 34*c*. At 130, the retaining element and the bias element may be inserted into the slot. That insertion may be performed by concurrently inserting both elements, or sequentially inserting either element first. At 140, an expander may be inserted into the retaining element.

Figure 11:
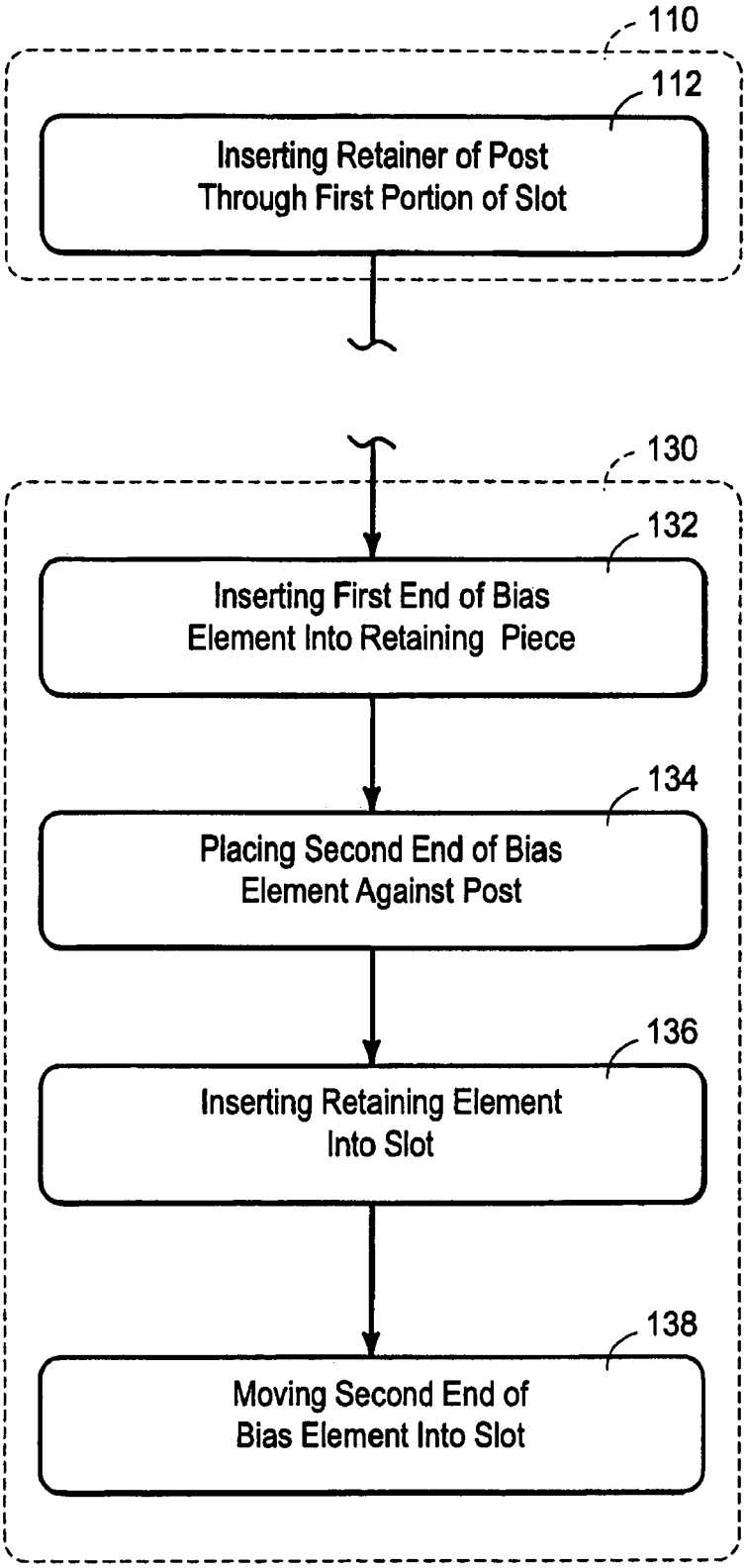
FIG. 11 is a flowchart that provides additional detail of the method illustrated in FIG. 10.

FIG. 11 provides additional detail to portions of flowchart 100 in FIG. 10 in a further and optional example of a method for, assembling a locking mechanism, such as locking mechanism 28. Inserting the post may include inserting the retainer of the post through the first portion of the slot at 112. Additionally, or alternatively, inserting the retaining element and the bias element may include inserting the second end of the bias element into the retaining element at 132, placing the first end of the bias element against the post at 134, inserting the retaining element into the slot at 136, and/or moving the first end of the bias element into the slot at 138. Additionally, placing the first end of the bias element against the post may include placing that first end against one of the retainers. Optionally, placing the first end of the bias element may be placed directly against the pin, bypassing step 138. The steps illustrated in FIGS. 10 and 11 may be performed in different sequences and in different combinations, not all steps being required for all examples.

Another embodiment of the invention is illustrated and described with reference to FIGS. 12A-12E. A folding knife 200 is shown in a closed, or folded, configuration in FIG. 12A. The knife 200 includes a handle 210 and a blade 212, with the blade pivotably coupled to the handle 210 and received therein in a conventional manner. A pivot pin 214 couples the handle 210 to the blade in a per se known manner.

While the knife 200 is shown in a side elevation, the handle 210 includes an opening or channel to receive the blade 212 (see, for example, FIGS. 1 and 2). In the embodiment of FIGS. 12A-12E, the back 206 also includes an opening configured to permit passage of a portion 234 of the tang 228 to pass therethrough as the blade 212 moves to and from the closed position. A stop pin 226 in the handle is positioned to delimit rotation of the blade 212 relative to the handle 210, as will be described further below. An end face 236 of the handle 210 includes a lobe 244, a sloping shoulder 238, and a locking surface 240. The handle of the present embodiment is symmetrical, such that the side not shown has a lobe, a sloping shoulder, and a locking surface. For convenience these features will generally be described in the singular. Other embodiments may be asymmetrical, such that the features shown are provided on only one side of the handle.

The handle 210 may comprise a combination of additional components that includes any of liners, scales, spacers, fasteners, bolsters, or other appropriate features, depending on the particular design. The pivot pin 214 may be a rivet, a machine screw, a captured pin, or any other appropriate structure, and may also include a bushing or bearing, according to the design of the particular embodiment of the invention.

The blade 212 comprises a locking structure 216 having a slot 218 and a post 220. For convenience the slot 218 is shown as having a shape similar to that of the slot 34 described with reference to FIGS. 1-6, but is not limited to the shape shown. The slot 218 has a first end 219, closest to the pivot pin 214, and a second end 217, farthest from the pivot pin 214. The post 220 is configured to slide along the slot between a locking position, toward the first end 219 of the slot 218, and a releasing position, toward the second end 217 of the slot 218, in a manner similar to that described with reference to previous embodiments. The locking structure also includes a biasing member configured to bias the post 220 toward the first end 219 of the slot 218. For simplicity, the details of the biasing member are not shown, but it will be understood that features of the bias element 36, described with reference to FIGS. 1-9, may be employed. Other styles of biasing members that provide equivalent structure or results also fall within the scope of the invention.

The post 220 includes a pin 224 and first and second studs 222, configured to cooperate with the slot 218 in a manner similar to that described with reference to previous embodiments. The spacing between the studs 222 is such that the post 220 is free to rotate around an axis that is parallel to the axis of the pivot pin 214. The pin 224 and studs 222 may be a unitary component or, alternatively, may comprise separate parts, as described previously with reference to other embodiments of the invention. The studs 222 of the embodiment of FIGS. 12A-12E have a hexagonal shape, with six faces 242, which will be discussed further, below.

The first and second studs of the present embodiment are symmetrical, as viewed from along the plane of the blade.

However, according to other embodiments, the first stud may have a different shape than the second stud. Alternatively, some embodiments may include a stud on one side of the blade, only. Accordingly, the studs of the pictured embodiments will hereafter be described in the singular form, and it will be understood that the opposite side may be symmetrical or non-symmetrical, and that either configuration falls within the scope of the invention.

Figure 12A:
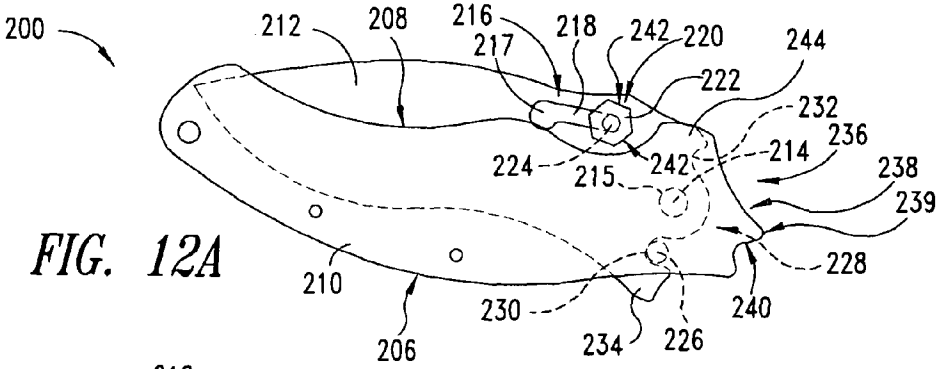
FIGS. 12A-12E illustrate a folding knife according to an embodiment of the invention with the blade in various positions between the open and closed positions.

The tang 228 of the blade 212 includes first and second notches 230, 232 configured to receive therein the stop pin 226 at the full closed and full open positions of the blade, respectively. FIG. 12A shows the blade 212 in the full closed position, with the stop pin 226 engaging the first notch 230, while FIG. 12E shows the blade 212 in the full open position, with the stop pin 226 engaging the second notch 232. In the embodiment shown, a single stop pin 226 limits travel of the blade 212 in both the open and closed position. Other embodiments of the invention may include separate stop pins or other structures configured to limit the blade travel. Additionally, other embodiments may not include defined notches in the tang, but may employ other means for limiting travel of the blade. Such means may include an arcuate slot formed in the blade, a bearing surface provided on the blade, etc.

Figure 12D:
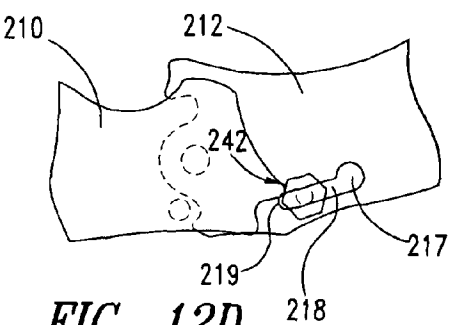
Figure 12C:
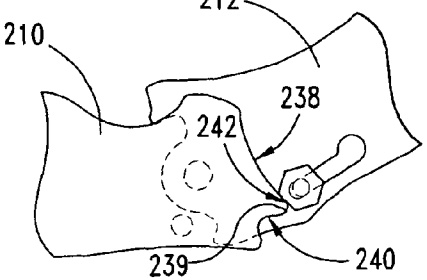
Figure 12E:
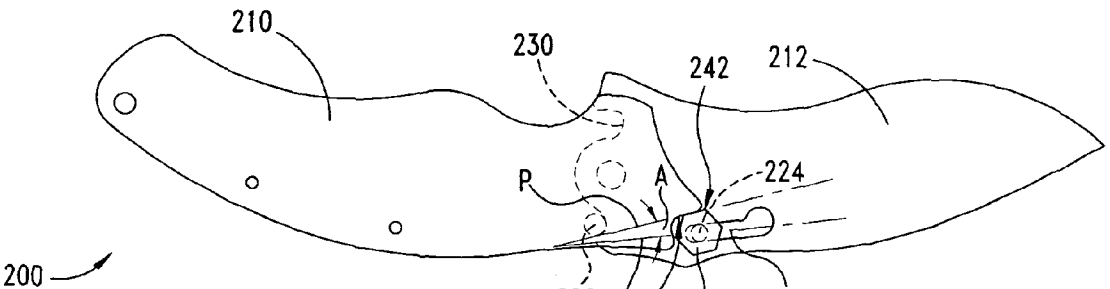
Figure 12B:
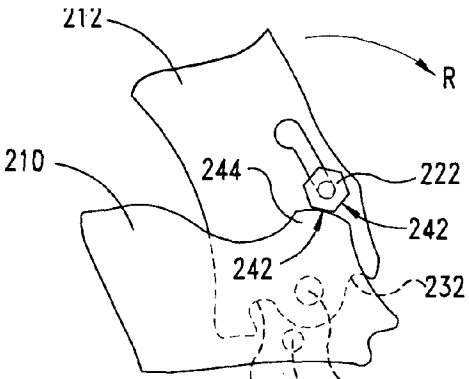

FIGS. 12B-12D show portions of the handle 210 and blade 212 of the knife 200 at progressive stages between the full closed position, pictured in FIG. 12A, and the full open position, pictured in FIG. 12E.

In the closed position, as shown in FIG. 12A, it may be seen that the post 220 is spaced away from the front 208 of the handle 210, such that rotation thereof is unimpeded. During normal handling and carrying of the knife 200 by a user, the angular position of the post 220 will change in a somewhat random manner. While in the closed position, the post 220 and studs 222 can rotate freely, since they are not in contact with any part of the handle. As shown in FIG. 12B, as the blade 212 is rotated from the full closed position toward the open position in direction R, the post 220 passes the lobe 244. Depending on the angular position of the hexagonal stud 222, there may be some contact between the lobe and the stud as the stud 222 rotates such that one of the faces 242 aligns with the front surface of the lobe 244.

Referring now to FIG. 12C, as the blade continues to rotate in direction R, the stud 222 makes contact with the sloping shoulder 238. As rotation continues further, one of the faces 242 slides along the shoulder 238, and the post 220 slides toward the first end 217 of the slot 218, being pressed by the biasing force of the biasing member (see FIGS. 6-9 and the accompanying text).

As seen in FIG. 12D, as the blade 212 rotates closer to the full open position, the stud 222 passes over the corner 239 separating the shoulder 238 from the locking surface 240. As the stud 222 passes over the corner 239, the stud rotates such that the face 242 rounds the corner 239, remaining in contact with the shoulder 238, and then with the locking surface 240. When the blade 212 reaches the full open position, as shown in FIG. 12E, the biasing member drives the post back toward the first end 219 of the slot 218 until the face 242 firmly engages the surface 240, with the second notch 230 of the blade 212 in firm engagement with the stop pin 226.

Referring to FIG. 12E, it may be seen that, when the folding knife 200 is in the full open position, the line of movement of the pin 224 in the slot 218 is at a slight angle, with respect to the locking surface 240. That is to say that, if a line L is extrapolated along the direction of movement of the pin 224, which for this design is down the center of the slot 218 from the second end 217 to the first end 219, and a plane P is extrapolated from the locking surface 240, the line L and the plane P will converge to the left of the locking structure 216, as viewed in FIG. 12E. In the embodiment shown, this convergence angle A is around 8°. Other embodiments may have other angles of convergence. It is preferred that the angle of convergence be between 25 and 5 degrees, with about 8-12 degrees being preferred.

The slot 218 is sized and positioned such that, when the face 242 of the stud 222 is firmly engaged with the locking surface 240, with the blade 212 in the full open position, the pin 224 is not at the extreme first end 219 of the slot 218. The biasing element continues to exert force to push the post 220 toward end 219.

Features of the present embodiment provide several significant advantages over previously known knives, some of which will be described below.

The flat surfaces of the hexagonal stud 222 present a relatively large surface area in contact with the locking surface, and so have a reduced tendency to damage the locking surface, in contrast to round shaped studs, which concentrate force applied against the lock to a small area, and thus may create an impression on the locking surface, over time.

Because the post 224 is able to rotate while the blade is in the closed position, different faces of the stud 222 will be presented against the locking surface 240 as the knife is repeatedly opened and closed. Therefore, while the stud surfaces 222 may wear over time, the wear will be distributed over the six surfaces of the hexagonal shaped stud 222. Accordingly, the stud 222 will be able to repeatedly provide a secure engagement with the locking surface 240 for much longer than if only one face were engaging the locking surface each time the knife was used.

Because the post 224 travels along a line that converges with the plane of the locking surface 240, the distance between the post 224 and the locking surface 240 varies as the position of the post changes. Thus, as the biasing element drives the post 224 toward the first end of the slot, the stud 222 engages the locking surface before the pin reaches the end of the slot 218, and any slack in the knife mechanism is absorbed, to provide a solid lock. This allows the locking mechanism to compensate for variations in spacing due to tolerances in the manufacturing process.

Over many years of use, the stud and the locking surface may wear a few thousandths of an inch, which would tend to increase the separation between them when the blade is locked open. This is avoided because the stud merely moves closer to the first end of the slot, which compensates for the added separation.

Some common locking mechanisms used in known folding knives are the lock-back style lock, and the frame-lock style. The lock-back lock employs a pawl that engages a notch in the tang of the blade at a point directly behind the pivot pin. The frame lock employs a plate that is biased sideways against the tang directly in front of the pivot pin such that the plate drops into the plane of the blade and engages a shoulder of the tang, as the shoulder clears the plate during opening. In both these lock styles the contact point between the locking mechanism and the blade is very nearly directly in front or in back of the pin, where the distance from the pin to the front or back of the handle is the smallest. With the pivot pin as a fulcrum, a force applied to the tip of the blade in the closing direction is significantly magnified against the lock, which can cause the lock to fail. In these prior art designs, the distance from the pivot pin 214 to the contact point for the lock is not ever greater than the distance between the pivot pin and the back of the knife. Namely, the height h of the knife limits the maximum distance permitted between the lock contact point and the pivot pin 214.

According to principles of the invention, the distance between the pivot pin 214 and the point where the stud 222 and the locking surface 240 meet is relatively much greater than the locking distances of prior art locks. The locking point is at the front of the knife, in the direction the blade extends. This distance can easily be made longer without affecting the feel of the knife. The end face 236 of the knife handle can have a large range of shapes and dimensions, to permit the distance from the pivot pin 214 to the locking contact point to be a selected distance based on the knife handle design that is selected. Thus, the factor of magnification is correspondingly lower, and the locking action is safer and more robust.

While the present embodiment has been described with reference to a hexagonal stud, other polygonal shapes may also be employed, and fall within the scope of the invention. For example, the stud may have three, four, five, seven, or more sides.

FIG. 13 illustrates a folding knife 250, according to another embodiment of the invention. The slot 252 is oriented closer to the tang 228 of the blade 212 than in the previous embodiment. A biasing member (not shown) is positioned in the slot 252 between the post 220 and the first end 254 of the slot 252. The biasing member is configured to pull the post 220 toward the first end 254 of the slot 252. In this embodiment, the slot 252 is at least partially hidden within the handle 210 while in the open position.

FIG. 14 illustrates a folding knife 290 according to an embodiment of the invention. A post 296 includes a square or rectangular pin 298 to which the stud 292 is rotatably fixed. Thus, while the stud 292 is free to rotate as described with reference to previous embodiments, the angular position of the pin is fixed within the slot 218 by its square shape. The stud 292 is fixed off-center with respect to the pin 298, such that, by selecting the angular position of the pin 298 in the slot 218, the distance between the center of the slot 218 and each of the faces of the stud 292 that make contact with the locking surface 240 can be adjusted. In this way, if the stud 292 and the locking surface 240 wear enough to result in a gap between the stud 292 and the locking surface 240, the pin 298 can be rotated in the slot 218 to bring the surfaces of the stud 292 closer to the locking surface 240. This rotation can be done, for example, by removing one of the studs 292 from the pin 298 so that the pin can be withdrawn from the slot 218 and replaced at a different angle.

FIGS. 15A and 15B show a folding knife 260 in side and back views, respectively, in which the stud 262 has a top-hat shape, in which the stud 262 has a first diameter $D_1$ close to the blade 212 and a second diameter $D_2$, greater than the first diameter, farther from the blade 212, as may be seen in FIG. 15B. The locking surface 264 is correspondingly shaped to conform to the shape of the stud 262. The stud 262 may be configured to bear on the locking surface 264 at either of the first or second diameters $D_1$, $D_2$, or at both.

FIGS. 16A and 16B show a folding knife 270 in side and back views, respectively, in which the stud 272 has a reverse top-hat shape, in which the first diameter $D_3$, closest to the blade 212, is greater than the second diameter $D_4$, farther away from the blade 212. The locking surface 274 is again correspondingly shaped to conform to the shape of the stud 272. This configuration may provide addition stabilization for the blade 212, inasmuch as the first diameter portion $D_3$ of the stud 272 may be configured to act as a shim between the blade 212 and the handle 210. As with the embodiment described with reference to FIGS. 15A and 15B, the stud 272 may be configured to bear on the locking surface at either of the first or second diameters $D_3$, $D_4$, or at both.

FIGS. 17A and 17B show a folding knife 280 in side and back views, respectively, in which the stud 282 has a conical shape that tapers from a first diameter $D_5$ close to the blade 212 to a second diameter $D_6$, greater than the first diameter, farther away from the blade 212. The locking surface 284 includes a corresponding taper such that the area of contact between the stud 282 and the locking surface 284 is increased. The upper portion 286 of the stud 282 may be given any convenient shape. For example, the shape of the upper portion 286 may be selected to provide secure purchase of a user's thumb for ease of use.

In the embodiments of FIGS. 15A-17B, the respective studs are shown as being round, as viewed in side elevation. Embodiments described or illustrated as being round may also be polygonal in shape. The term diameter may be understood as referring to the dimension of an imaginary circle that is defined by the points of the angles of the polygon. For example, in the embodiment described with reference to FIGS. 15A and 15B, the first diameter $D_1$ of the stud 262 may be hexagonal, and configured to engage the locking surface 264 in a manner similar to that described with reference to the embodiment of FIGS. 12A-12E, while the second diameter $D_2$ of the stud 262 may be round or knurled for aesthetic reasons, or for a more secure contact by the user.

FIG. 18 illustrates a folding knife 300 including an oval shaped stud 302. Additionally, other non-polygonal, non-circular shaped studs are also considered to fall within the scope of the invention.

FIG. 19 shows a folding knife 310, according to another embodiment of the invention. The knife 310 includes a handle 312, a blade 314 and a locking mechanism 316.

The handle 312 includes first and second locking surfaces 318, 320 positioned adjacent to each other as shown and defining a notch 321. A stop node 323 is defined by the second locking surface 320, on one side, and the back 330 of the handle 312 on the other.

The locking mechanism 316 includes a slot and a post 322, itself including a stud 324 having first and second faces 326, 328 adjacent to each other and corresponding in contour and position to the first and second locking surfaces 318, 320, respectively. For clarity, the slot is not shown in FIG. 19. The slot may be formed, for example, as pictured or described with reference to other embodiments of the invention. Additionally, in FIG. 19 the stud 324 is shown partially withdrawn from engagement in the notch 321 in order to more clearly reference features of the embodiment. The locking mechanism also includes a biasing member, not shown, configured to bias the stud 324 toward the first end of the slot, as shown and described with reference to previous embodiments.

When the blade 314 is rotated from a closed to an open position, the stud 324 engages the sloping shoulder 238 in a manner similar to that described with reference to the embodiment of FIGS. 12A-12E. When the stud 324 passes the corner separating the shoulder 328 from the first locking surface 318, it drops into the notch 328 such that the first and second faces 326, 328 engage the first and second locking surfaces 218, 320, respectively. The blade is thus locked in the open position and prevented from rotating either back toward the closed position or further beyond the open position. It will be noted that the handle 312 is not provided with a stop pin to prevent over rotation, since this function is by the engagement of the stud 324 with the locking surfaces 318, 320. While the stud 324 is shown in FIG. 19 as having a flattened disc shape, the stud 324 may be formed in any of a wide variety of shapes. For example, the stud 324 may be round; oval, or hexagonal, and the locking surfaces 318, 320 shaped conform to the selected shape of the stud 324.

According to one embodiment, the handle 312 and the locking mechanism 316 are so configured that, when the blade is positioned in the closed position, the stud 324 rests against, or engages, a portion of the front 332 of the handle 312, thereby obviating the need for a stop pin or other structure configured to limit rotation of the blade 314 toward the closed position.

According to another embodiment, the stop node 328 is of a length sufficient that the stud 324 cannot pass over the stop node, even when the stud is moved the full extent of its travel toward the second end of the slot. Thus, the blade 314 cannot be over-rotated, even intentionally.

All of the above U.S. patents, U.S. patent application publications, U.S. patent applications, foreign patents, foreign patent applications and non-patent publications referred to in this specification and/or listed in the Application Data Sheet, are incorporated herein by reference, in their entirety.

From the foregoing it will be appreciated that, although specific embodiments of the invention have been described herein for purposes of illustration, various modifications may be made without deviating from the spirit and scope of the invention. Furthermore, features of various disclosed embodiments may be combined or omitted to form additional embodiments, which are considered to lie within the scope of the invention. Accordingly, the invention is not limited except as by the appended claims.

The invention claimed is:

1. A folding knife, comprising:

a handle having a locking surface on an end face thereof;

a blade having a tang end rotatably coupled to the handle to pivot about a first axis between a closed position and an open position; and a locking post slideably coupled to the blade and at least a portion being rotatable about a second axis that is parallel to the first axis, the post having at least one face that is substantially flat, and whose contour conforms to a contour of the locking surface and engages the locking surface when the blade is in the open position, to lock the blade in the open position, the handle further including a sloping shoulder on the end face, and a corner between the shoulder and the locking surface, the shoulder and corner positioned such that, as the blade is rotated toward the open position, the post makes contact with the sloping shoulder and, as the blade continues to rotate toward the open position, is compelled by the sloping shoulder to move generally toward the point end of the blade until it passes the corner, whereupon the post is able to move toward the tang end of the blade.

2. The folding knife of claim 1 wherein, when the post makes contact with the sloping shoulder, the flat face makes contact with the sloping shoulder and slides along the sloping shoulder as the blade rotates toward the open position, the post rotating such that the face stays in contact with the corner as the post passes the corner, the flat face of the post sliding into contact with the locking surface as the blade rotates to the open position.

3. A folding knife, comprising:

a handle;

a blade having a tang end coupled to the handle, the blade configured to rotate, relative to the handle, around a first axis, between a closed position and an open position; and a locking mechanism coupled to the blade and configured to engage a locking surface of the handle when the blade is in the open position, and including a locking post configured to move between a locking and a releasing position, a portion of the locking post being rotatable relative to the blade, the locking post including a stud having a polygonal shape, the stud being configured to engage a feature of the handle with any one of the polygonal facets to lock the blade in the open position.

4. The folding knife of claim 3 wherein the polygonal stud is hexagonal.

5. A folding knife, comprising:

a handle having a locking surface on an end face thereof;

a blade having a tang end rotatably coupled to the handle to pivot about a first axis between a closed position and an open position; and a locking post slideably coupled to the blade and at least a portion being rotatable about a second axis that is parallel to the first axis, the post including a stud that is hexagonal in shape, is positioned above a plane defined by the blade, and has at least one face whose contour conforms to a contour of the locking surface and engages the locking surface when the blade is in the open position, to lock the blade in the open position, the at least one face being one of six faces of the stud.

6. The folding knife of claim 5 wherein, when the blade is in the open position, the post is configured to slide along a line that converges with a plane defined by the locking surface.

7. The folding knife of claim 6 wherein the plane and the line converge at an angle of less than ten degrees.

8. The folding knife of claim 5 wherein the post is configured to slide along a slot formed in the blade.

9. The folding knife of claim 8, further comprising a biasing member configured to bias the post generally toward the tang of the blade.

10. The folding knife of claim 9 wherein the biasing member is positioned in the slot between the post and a point end of the blade.

11. The folding knife of claim 9 wherein the biasing member is positioned in the slot between the post and the tang end of the blade.

12. The folding knife of claim 5 wherein the handle includes an additional locking surface positioned adjacent to the locking surface such that, when the blade is rotated to the open position, the post is received between the locking surface and the additional locking surface and the blade is prevented from rotating beyond the locking position from the closed position.

13. The folding knife of claim 5 wherein the locking post includes an additional stud positioned below the plane defined by the blade.

14. The folding knife of claim 5 wherein the locking post includes a pin that is not rotatable with respect to the blade, and a stud that is rotatably fixed to the pin.

15. The folding knife of claim 14 wherein the stud is fixed to the pin off-center.

16. The folding knife of claim 5 wherein the stud varies in diameter along the second axis.

17. The folding knife of claim 16 wherein the stud has a first diameter at a portion of the stud closest to the blade and a second diameter, different from the first diameter, at a portion of the stud further from the blade.

18. The folding knife of claim 17 wherein the first diameter is greater than the second diameter.

19. The folding knife of claim 17 wherein the second diameter is greater than the first diameter.

20. The folding knife of claim 19 wherein the stud has a conical taper from the first diameter to the second diameter.

* * * * *